US010865622B2

(12) United States Patent
Fensky et al.

(10) Patent No.: US 10,865,622 B2
(45) Date of Patent: Dec. 15, 2020

(54) DEVICE AND METHOD FOR CLEANING A WELLBORE EQUIPMENT

(71) Applicant: Blue Spark Energy Inc., Calgary (CA)

(72) Inventors: Charles Fensky, Beaumont (CA); Robert Harries, Calgary (CA); Steve Petten, Calgary (CA)

(73) Assignee: Blue Spark Energy Inc., Calgary (CA)

( * ) Notice: Subject to any disclaimer, the term of this patent is extended or adjusted under 35 U.S.C. 154(b) by 207 days.

(21) Appl. No.: 16/148,914

(22) Filed: Oct. 1, 2018

(65) Prior Publication Data

US 2019/0100981 A1 Apr. 4, 2019

Related U.S. Application Data

(60) Provisional application No. 62/566,965, filed on Oct. 2, 2017.

(51) Int. Cl.
*E21B 37/00* (2006.01)
*E21B 37/10* (2006.01)

(52) U.S. Cl.
CPC ..... *E21B 37/00* (2013.01); *E21B 37/10* (2013.01)

(58) Field of Classification Search
CPC ..... E21B 37/00; E21B 37/10; E21B 33/12; E21B 37/08
See application file for complete search history.

(56) References Cited

U.S. PATENT DOCUMENTS 3,180,418 A * 4/1965 MacLeod ..... E21B 37/00 166/311
3,760,878 A * 9/1973 Peevey ..... E21B 33/124 166/185
4,345,650 A * 8/1982 Wesley ..... E21B 36/04 166/177.2
5,004,050 A * 4/1991 Sizonenko ..... E21B 43/003 166/248
6,227,293 B1 * 5/2001 Huffman ..... E21B 28/00 166/177.2
6,687,189 B1 * 2/2004 Schaefer ..... H01T 1/00 367/147
8,950,495 B2 * 2/2015 Barbour ..... E21B 28/00 166/177.1
9,810,041 B2 * 11/2017 Parker ..... E21B 28/00
2007/0187090 A1 * 8/2007 Nguyen ..... E21B 37/06 166/249

(Continued)

FOREIGN PATENT DOCUMENTS

EP 2940245 A1 * 11/2015 ..... E21B 43/25
EP 2977545 A1 * 1/2016 ..... E21B 37/08

*Primary Examiner* — Daniel P Stephenson
(74) *Attorney, Agent, or Firm* — Klein, O'Neill & Singh, LLP

(57) ABSTRACT

The invention relates to an electrical discharge generating device for cleaning an equipment arranged in a wellbore of a subterranean formation in order to improve the recovery of formation fluids and/or gases, said electrical discharge generating device comprising a discharge unit for generating at least one electrical discharge that propagates at least one shock wave for cleaning from said equipment, wherein said electrical discharge generating device further comprises a retaining module configured for retaining a volume of liquid in order to immerse the discharge unit.

12 Claims, 5 Drawing Sheets

(56) References Cited

U.S. PATENT DOCUMENTS

| | | | | |
|---|---|---|---|---|
| 2010/0071898 | A1* | 3/2010 | Corre | E21B 49/081 166/264 |
| 2011/0139441 | A1* | 6/2011 | Zolezzi Garreton | E21B 28/00 166/249 |
| 2013/0161007 | A1* | 6/2013 | Wolfe | E21B 43/263 166/297 |
| 2014/0027110 | A1* | 1/2014 | Ageev | E21B 43/24 166/249 |
| 2014/0060804 | A1* | 3/2014 | Barbour | E21B 37/00 166/70 |
| 2016/0024888 | A1* | 1/2016 | Parker | E21B 28/00 166/248 |
| 2019/0100981 | A1* | 4/2019 | Fensky | E21B 37/10 |
| 2019/0383124 | A1* | 12/2019 | Saltykov | E21B 43/25 |

* cited by examiner

DEVICE AND METHOD FOR CLEANING A WELLBORE EQUIPMENT

FIELD OF THE INVENTION

The field of the invention relates to the treatment of a wellbore equipment and, more particularly, to a device and a method for removing deposits from an equipment arranged in a wellbore of a subterranean formation in order to improve the recovery of formation fluids and/or gases. The device and method according to the invention may advantageously be used to remove deposits from e.g. a casing, a tubing or a well completion equipment.

BACKGROUND OF THE INVENTION

In the art of well boring, a borehole is drilled into the earth through the oil or gas producing subterranean formation or, for some purposes, through a water bearing formation or a formation into which water or gas or other liquids are to be injected.

Completion of a well may be carried out in a number of ways dependent upon the nature of the formation of interest. In particular, it is known to arrange a casing into the wellbore to control formation elements. Once installed into the wellbore, the casing is then perforated in a plurality of areas for allowing the passage of oil and/or gas from the formation into the casing. In order to produce formation fluids or gases, completion strings are arranged in the borehole. Such a completion string generally comes as a production tubing which comprises a plurality of different equipment such as, e.g. safety valves, sliding side doors, side pocket mandrels, etc.

In any event, after a period of production, injection or transportation of fluids or gases, there is a tendency for the different wellbore equipment to become plugged with various types of deposits such as debris or residues. For example, organic residues like scale, paraffin, asphalts and other gummy residues of petroleum origin often cause plugging problems.

Usually these deposits can cause significant problems, because of their composition and the fact that they can precipitate under certain conditions (pressure, temperature, composition). These materials of mineral or organic origins either together with chemicals from water, normally produced with the oil, such as, calcium carbonate, calcium sulfate, barium sulfate, sulfur and the like, or such chemicals themselves have a tendency to form extremely hard deposits on different parts of wellbore equipment. Such deposits can thus adhere to various equipment arranged in a borehole or a pipeline, restricting their use seriously and/or reducing or completely preventing the flow of fluids or gases through the completion string or the pipeline. For example, deposits may prevent opening or closing safety valves or sliding side doors, etc.

Such deposits are difficult to dissolve by known chemical means or to dislodge by known mechanical means. For example, chemical treatments, such as, treatments with acids, surface active agents and the like have been utilized in order to clean out scaled wellbore equipment. However, such techniques, while less expensive than a complete workover, are substantially less effective, since they are incapable, in most cases, of dissolving significant amounts of the plugging materials. Another technique, which can be classified as a mechanical technique and has also been suggested for the purpose of cleaning wellbore equipment, includes using brushes, scrapers or pigs. Such technique allows only removing most of the encrusted deposits in areas of the wellbore equipment which are easily accessible. However, brushes, scrapers or pigs are quite inefficient removing encrusted deposits in areas of the wellbore equipment accessible with difficulty or inaccessible. Consequently, it is often necessary to rework the well and replace one or several equipment of the completion string or the pipeline. Such tactics are, of course, both time-consuming and expensive.

Another method used for removing deposits consists in using an electrical discharge generating device which generates shock waves for creating an electrohydraulic effect. More precisely, in an existing solution, the electrical discharge generating device comprises electrodes in between which a high-voltage current is discharged. The discharge of said high-voltage current generates high-energy shock waves that transmit in the borehole toward the well completion equipment, the tubing, the casing and the subterranean formation. In order to transmit efficiently the shock waves to these different elements, it is necessary to discharge the current in a liquid. When the well is in production, a liquid fills the bottom of the borehole. This liquid can be a natural liquid of the well or an added liquid, such as water. Consequently, it is only possible to efficiently remove deposits on parts of wellbore equipment that are arranged under the surface of the liquid, i.e. that are immersed in the liquid.

In order to immerse elements to clean, an existing solution consists in filling the borehole with water until the targeted element (i.e. comprising deposits to remove) is immersed then use the electrical discharge generating device into the liquid. Such solution may be significantly time-consuming and costly.

It is therefore an object of the present invention to provide an improved device and method for efficiently, rapidly and easily remove deposits on equipment arranged on a borehole. It is another object of the present invention to reduce time and costs for removing deposits from elements that are not immersed in the liquid of the borehole.

SUMMARY OF THE INVENTION

To this end, the present invention concerns an electrical discharge generating device for cleaning an equipment arranged in a wellbore of a subterranean formation in order to improve the recovery of formation fluids and/or gases, said electrical discharge generating device comprising a discharge unit for generating at least one electrical discharge that propagates at least one shock wave for cleaning said equipment, wherein said electrical discharge generating device further comprises a retaining module configured for retaining a volume of liquid in order to immerse the discharge unit.

The device according to the invention allows therefore generating shock waves in a transmitting fluid, such as e.g. water or oil, retained by the retaining module so that it is transmitted up to the equipment to be cleaned. In the present description, the terms "wellbore liquid level" means the level of the liquid (or mix of liquids) that fills at least partially the wellbore and the terms "retained liquid" means the liquid that is retained by the retaining module of the device according to the invention. The device according to the invention allows thus efficiently, easily and rapidly to remove deposits from a wellbore equipment arranged in a wellbore, wherever the location of said wellbore in regard to the wellbore liquid. The wellbore equipment may be a completion string equipment, a tubing, a casing, etc. Thus, for example, the method may be advantageously used to remove deposits from a metallic casing disposed in the wellbore, improving therefore the recovery of formation fluids and/or gases. The device according to the invention provides an electrohydraulic cleaning process for efficiently and rapidly removing deposits from a wellbore equipment. In other words, electrohydraulic energy allows cleaning a wellbore equipment in order to improve the recovery of oil and/or gas. The device is a source of electrohydraulic energy, which allows advantageously removing deposits and cleaning equipment arranged in a wellbore whatever their location in said wellbore.

In a preferred embodiment, the retaining module comprises a retaining element configured to retain a liquid in order to immerse the discharge unit when positioned in a wellbore. Advantageously, the retaining element may be mounted in a removable way on the device in order to use the device with or without the retaining module.

In a preferred embodiment, the retaining element is made of a plastic material, for keeping the retaining element light, cheap and strong.

Advantageously, the device comprising a body and said body comprising a bottom part, the retaining element is fixed to said bottom part of said body. The retaining element may thus retain a liquid in order to immerse efficiently the discharge unit.

In a preferred embodiment, the retaining element is fixed to the bottom part of the body of the device via a rod or a shaft, allowing therefore adding a distance between the retaining element and the body of the device.

In a first embodiment, the retaining element is a cone, the vertex of which pointing downwards, extending under the bottom part of the body of the device and configured to retain a liquid in order to immerse the discharge unit when positioned in a wellbore.

In a second embodiment, the retaining element comprises a plurality of rings configured to retain a liquid in order to immerse the discharge unit when positioned in a wellbore.

In a third embodiment, the retaining element is an inflatable element extending from the bottom part of the body and configured to retain a liquid in order to immerse the discharge unit when positioned in a wellbore.

In another embodiment of the device, the electrical discharge generating device comprising a body and said body comprising a bottom part, said bottom part is shaped so as to retain a liquid in order to immerse the discharge unit when positioned in a wellbore. The retaining module is thus integrated to the body of the device.

In an embodiment, the bottom part is made of a plastic material, for keeping the retaining element light, cheap and strong.

Alternatively, the bottom part may be made of a metal material.

In a first embodiment, the bottom part comprises a cone shaped portion, the vertex of which pointing downwards, configured to retain a liquid in order to immerse the discharge unit when positioned in a wellbore.

In a second embodiment, the bottom part comprises a plurality of rings configured to retain a liquid in order to immerse the discharge unit when positioned in a wellbore.

In a third embodiment, the bottom part comprises an inflatable element configured to retain a liquid in order to immerse the discharge unit when positioned in a wellbore.

In an embodiment according to the invention, a series of at least ten shock waves, preferably twenty shock waves, is generated toward the same part of an equipment for efficiently cleaning said part.

In a preferred embodiment, a plurality of series of shock waves is generated. Each series of shock waves may be generated repeatedly at different locations along the wellbore equipment, for example different heights of a casing. Preferably, the different locations correspond to different locations of an equipment to be clean above the wellbore liquid level.

Preferably, the discharge unit comprises a first electrode and a second electrode for generating a high voltage arc.

In an embodiment, the discharge unit is configured for generating at least one electrical discharge that propagates at least one shock wave radially.

In another embodiment, the discharge unit is configured for generating at least one electrical discharge that propagates at least one shock wave in a predetermined direction. For example, the device may comprise a reflector allowing propagating the at least one shock wave in a predetermined direction.

According to an embodiment, the electrical discharge generating device comprises a chamber which is at least partially filled with a shock wave transmitting liquid and a membrane delimiting at least partially said chamber. In particular, such membrane isolates the liquid in the chamber from elements of the wellbore surrounding the shock wave generating device, such as e.g. mud or other fluids, while maintaining acoustic coupling with the wellbore equipment, improving thus the propagation of shockwaves while preventing external fluids from damaging the discharge unit. Such flexible membrane prevents in particular the deposits and other elements from damaging electrodes and other components (insulators) of the discharge unit.

Preferably, the membrane is deformable and/or flexible and/or elastic in order to prevent the at least one shock wave to bounce on it and to conduct efficiently the at least one shock wave toward the wellbore equipment.

Advantageously, the membrane is made of fluorinated rubber or other fluoroelastomer.

Advantageously, the relative elongation of the membrane is at least 150%, preferably at least 200% in order to be used efficiently in oils, fuels, liquid reservoirs, aliphatic or aromatic hydrocarbons etc.

Advantageously, the membrane is operable between −35° C. and 250° C. in order to be used in oils, fuels, liquid reservoirs, aliphatic and/or aromatic hydrocarbons etc.

In another embodiment, the electrical discharge generating device comprises at least one metallic wire mounted between the first electrode and the second electrode for creating a pressure wave. When a current circulates between the first electrode and the second electrode, the at least one metallic wire heats until vaporization, generating therefore a pressure wave that propagates into the fluid.

In an embodiment, the electrical discharge generating device further comprises a power conversion unit, a power storage unit and a control unit.

In an embodiment, the device further comprises a connection means, coupled to said device for lowering said device into the wellbore nearby a wellbore equipment, and an electrical circuit mounted within said connection means for connecting a voltage source located external of the wellbore to the device. For example, the connection means may be a wireline for a vertical wellbore, a wireline tractor for pushing the device into both vertical or horizontal wellbores or a coiled tubing for both vertical or horizontal wellbores. In the case of a coiled tubing, the device is mounted on the coiled tubing which is then introduced into the wellbore.

The invention also concerns the use of an electrical discharge generating device as previously described for cleaning a wellbore equipment arranged in a wellbore of a subterranean formation in order to improve the recovery of formation fluids and/or gases.

The invention also concerns a wellbore for recovering formation fluids or gases from a subterranean formation, said wellbore comprising at least one wellbore equipment arranged into said wellbore and an electrical discharge generating device as previously described arranged in said wellbore at least partially immersed in some retained liquid nearby of (i.e. facing or next to) said wellbore equipment.

The invention also relates to a method for cleaning an equipment arranged in a wellbore of a subterranean formation using an electrical discharge generating device in order to improve the recovery of formation fluids and/or gases, said electrical discharge generating device comprising a discharge unit for generating at least one electrical discharge that propagates at least one shock wave for cleaning said equipment, wherein, the device comprising a retaining module configured for retaining a volume of liquid in order to immerse the discharge unit, the method comprises the steps of positioning the device next to a wellbore equipment, filling a liquid in the wellbore so that retaining module retains a volume of liquid in order to immerse the discharge unit, and generating at least one electrical discharge into said retained liquid that propagates at least one shock wave for cleaning said equipment.

BRIEF DESCRIPTION OF THE DRAWINGS

These and other features, aspects, and advantages of the present invention are better understood with regard to the following Detailed Description of the Preferred Embodiments, appended Claims, and accompanying Figures, where:

Figure 1:
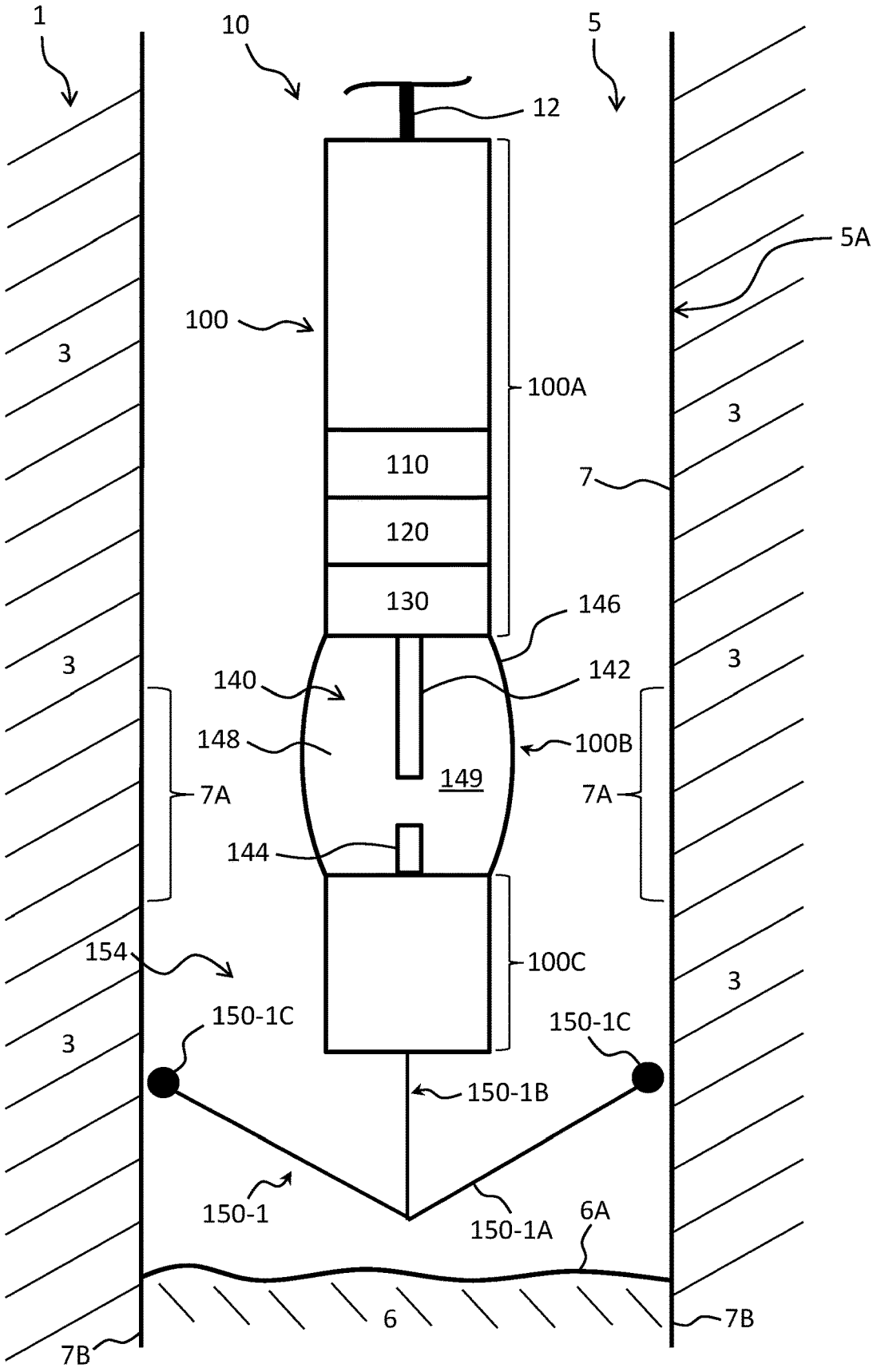
FIG. 1 schematically illustrates a cross-sectional view of a wellbore comprising a casing and a first embodiment of an electrical discharge generating device according to the invention.
Figure 2:
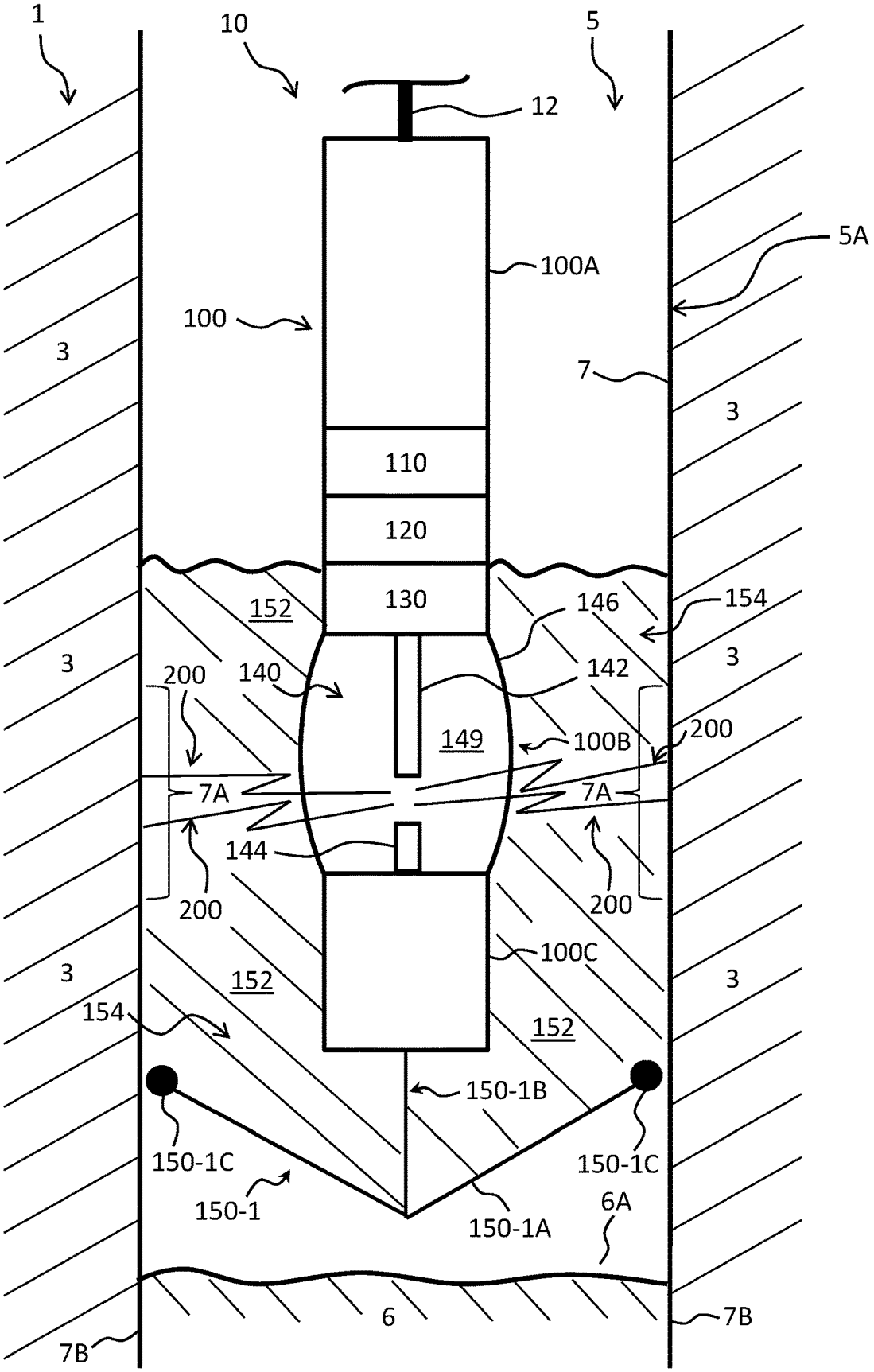
FIG. 2 schematically illustrates the device of FIG. 1 wherein the retaining module retains liquid.

In the accompanying Figures, similar components or features, or both, may have the same or a similar reference label.

DETAILED DESCRIPTION

The Specification, which includes the Summary of Invention, Brief Description of the Drawings and the Detailed Description of the Preferred Embodiments, and the appended Claims refer to particular features (including process or method steps) of the invention. Those of skill in the art understand that the invention includes all possible combinations and uses of particular features described in the Specification. Those of skill in the art understand that the invention is not limited to or by the description of embodiments given in the Specification. The inventive subject matter is not restricted except only in the spirit of the Specification and appended Claims. Those of skill in the art also understand that the terminology used for describing particular embodiments does not limit the scope or breadth of the invention. In interpreting the Specification and appended Claims, all terms should be interpreted in the broadest possible manner consistent with the context of each term. All technical and scientific terms used in the Specification and appended Claims have the same meaning as commonly understood by one of ordinary skill in the art to which this invention belongs unless defined otherwise. As used in the Specification and appended Claims, the singular forms "a", "an", and "the" include plural references unless the context clearly indicates otherwise. The verb "comprises" and its conjugated forms should be interpreted as referring to elements, components or steps in a non-exclusive manner. The referenced elements, components or steps may be present, utilized or combined with other elements, components or steps not expressly referenced. The verb "couple" and its conjugated forms means to complete any type of required junction, including electrical, mechanical or fluid, to form a singular object from two or more previously non-joined objects. If a first device couples to a second device, the connection can occur either directly or through a common connector. "Optionally" and its various forms means that the subsequently described event or circumstance may or may not occur. The description includes instances where the event or circumstance occurs and instances where it does not occur. "Operable" and its various forms means fit for its proper functioning and able to be used for its intended use. Spatial terms describe the relative position of an object or a group of objects relative to another object or group of objects. The spatial relationships apply along vertical and horizontal axes. Orientation and relational words including "uphole" and "downhole"; "above" and "below"; "up" and "down" and other like terms are for descriptive convenience and are not limiting unless otherwise indicated. Where the Specification or the appended Claims provide a range of values, it is understood that the interval encompasses each intervening value between the upper limit and the lower limit as well as the upper limit and the lower limit. The invention encompasses and bounds smaller ranges of the interval subject to any specific exclusion provided. Where the Specification and appended Claims reference a method comprising two or more defined steps, the defined steps can be carried out in any order or simultaneously except where the context excludes that possibility.

The invention is described hereunder in reference to a well for producing formation fluids or gases such as e.g. oil wherein the formation is a sand formation. This does not limit the scope of the present invention which may be used with any type of formation.

FIG. 1 shows a subterranean formation 1 comprising a treatment zone 3. For example, such a treatment zone 3 may be made of rock. The treatment zone 3 may comprise a porous zone that constitutes a reservoir of hydrocarbons, such as oil or gas. Such porous zone may be accessible through a wellbore 5 extending from the surface through to the treatment zone 3. The treatment zone 3 interfaces with the wellbore 5 at wellbore wall 5A and extends radially from wellbore 5.

In the example illustrated on FIG. 1, the wellbore wall 5A comprises a wellbore equipment which is here a metallic casing 7. This casing 7 may comprise perforations that allow creating some flow paths within the treatment zone 3 adjacent to the wellbore 5. In another embodiment, the wellbore equipment could be for example a completion string equipment, a production tubing element or any type of equipment arranged in the wellbore 5.

The wellbore 5 is partially filled with a liquid, called "wellbore liquid" 6 that reaches a given wellbore liquid level 6A. In this example, some parts 7A of the casing 7 are arranged above said wellbore liquid level 6A (i.e. in a dry volume of the wellbore 5), whereas some parts 7B of the casing 7 are arranged under the wellbore liquid level 6A. Alternatively, the wellbore 5 could be completely dry (i.e. deprived of liquid).

FIG. 1 describes an exemplary embodiment of an electrical discharge generating device 10 according to the invention. The electrical discharge generating device 10 is configured for generating electrical discharges that propagate shock waves 200, in particular for cleaning an equipment arranged in the wellbore 5 in order to improve the recovery of formation fluids and/or gases. In this illustrated example, the electrical discharge generating device 10 constitutes a source of electrohydraulic energy that can be arranged into the wellbore 5 near (i.e. next to) a part 7A of the casing 7 that needs cleaning, for example to remove deposits.

As illustrated on FIGS. 1 to 4, the electrical discharge generating device 10 is coupled to a wireline 12 which is operable to raise and lower said electrical discharge generating device 10 and to supply power from the surface to said electrical discharge generating device 10. A voltage source (not shown) located external of the wellbore 5 and an electrical circuit (not shown) mounted within said wireline 12 allow to connect said voltage source to the electrical discharge generating device 10. Electrical power is supplied by the low voltage source at a steady and relatively low power from the surface through the wireline 12 to the downhole electrical discharge generating device 10.

As illustrated on FIGS. 1 to 4, the electrical discharge generating device 10 comprises a cylindrically-shaped body 100 connected to the wireline 12. The body 100 comprises a top part 100A, an intermediate part 100B and a bottom part 100C.

In this example, and as already describes in U.S. Pat. No. 4,345,650 issued to Wesley or U.S. Pat. No. 6,227,293 issued to Huffman, incorporated hereby by reference, the electrical discharge generating device 10 comprises a power conversion unit 110, a power storage unit 120, a control unit 130, mounted inside the top part 100A of the body 100, and a discharge unit 140 located in the intermediate part 100B of the body 100.

The power storage unit 120 comprises a plurality of capacitors (not represented) for storage of electrical energy that allows the discharge unit 140 to generate one or a plurality of electrical discharges. The power conversion unit 110 comprises suitable circuitry for charging capacitors of the power storage unit 120. Timing of the discharge of the energy from the power storage unit 120 through the discharge unit 140 is controlled by the control unit 130. In a preferred embodiment, the control unit 130 is a switch, which discharges when the voltage reaches a predefined threshold.

The discharge unit 140 comprises a first electrode 142, mounted on the bottom of the top part 100A, and a second electrode 144, mounted on the top of the bottom part 100C, configured for triggering an electrical discharge. The discharge unit 140 may be configured to propagate shock waves radially or in a predetermined direction. Upon discharge of the capacitors of the power storage unit 120 through the first electrode 142 and the second electrode 144, electrohydraulic shock waves 200 are generated as shown on FIGS. 2 to 4. According to the electrohydraulic effect, an electrical discharge is discharged in a very short time (few micro seconds).

In this example, the discharge unit 140 further comprises a membrane 146 delimiting a chamber 148 (illustrated on FIG. 1) which is filled with a shock wave internal transmitting liquid 149, allowing transmitting shock waves through the membrane 146 toward the casing 7. In another embodiment, the discharge unit 140 may not comprise any membrane 146. Such membrane 146 isolates the discharge unit 140 from the wellbore 5 while maintaining acoustic coupling with said wellbore 5, improving the propagation of shockwaves while preventing external fluids from the wellbore 5 from damaging the discharge unit 140. In a preferred embodiment, the membrane 146 is flexible in order to an efficient propagation of shock waves in many directions and prevent shock waves to bounce on it, allowing therefore an efficient conduction of the shock wave toward a metal patch to be sealed on the casing 7. To this end, the membrane 146 may be made of fluorine rubber or fluoroelastomer with a relative elongation of at least 150%, preferably at least 200% and being operable between −35° C. and 250° C. Other designs of discharge unit 140 are disclosed in U.S. Pat. No. 6,227,293 issued to Huffman which is included hereby reference.

In reference to FIGS. 1 to 4, the electrical discharge generating device 10 also comprises a retaining module 150-1, 150-2, 150-3 mounted under the bottom part 100C of the body 100.

The retaining module 150-1, 150-2, 150-3 is configured for retaining a volume of liquid in order to immerse the discharge unit 140. The retaining module 150-1, 150-2, 150-3 allows creating, at least temporarily, a column of external transmitting liquid 152, as illustrated on FIGS. 2 to 4, for immersing the discharge unit 140, enabling therefore an efficient use of said discharge unit 140 to remove deposits from the parts 7A of the casing 7 which are arranged above the wellbore liquid level 6A.

The retaining module 150-1, 150-2, 150-3 acts at least partially as a seal, which is not necessarily fully waterproof, in order to block some liquid that is added from the top of the electrical discharge generating device 10 for the duration of the cleaning of the wellbore equipment (i.e. the parts 7A here) as described hereafter.

In a preferred embodiment, the retaining module 150-1, 150-2, 150-3 is mounted on the bottom part 100C of the body 100 of the electrical discharge generating device 10 and defines the bottom limit of an open volume 154, the sides of said volume 154 being defined by the casing 7 (or the production tubing or the wall 5A of the wellbore 5). The element to clean (i.e. to remove the deposits from) lies in the defined volume 154: in this example, some parts 7A of the casing 7 that comprise deposits to remove.

The retaining module 150-1, 150-2, 150-3 may have different shapes and dimensions. In a first embodiment illustrated on FIGS. 1 and 2, the retaining module 150-1 is in the shape of a cone 150-1A, whose vertex points downwards and which is mounted to the bottom part 100C using a rod 150-1B extending vertically from the bottom part 100C below the body 100. The retaining module 150-1 optionally comprises an annular element 150-1C for sealing the interface between the cone 150-1A and the part 7A of the casing 7.

Figure 3:
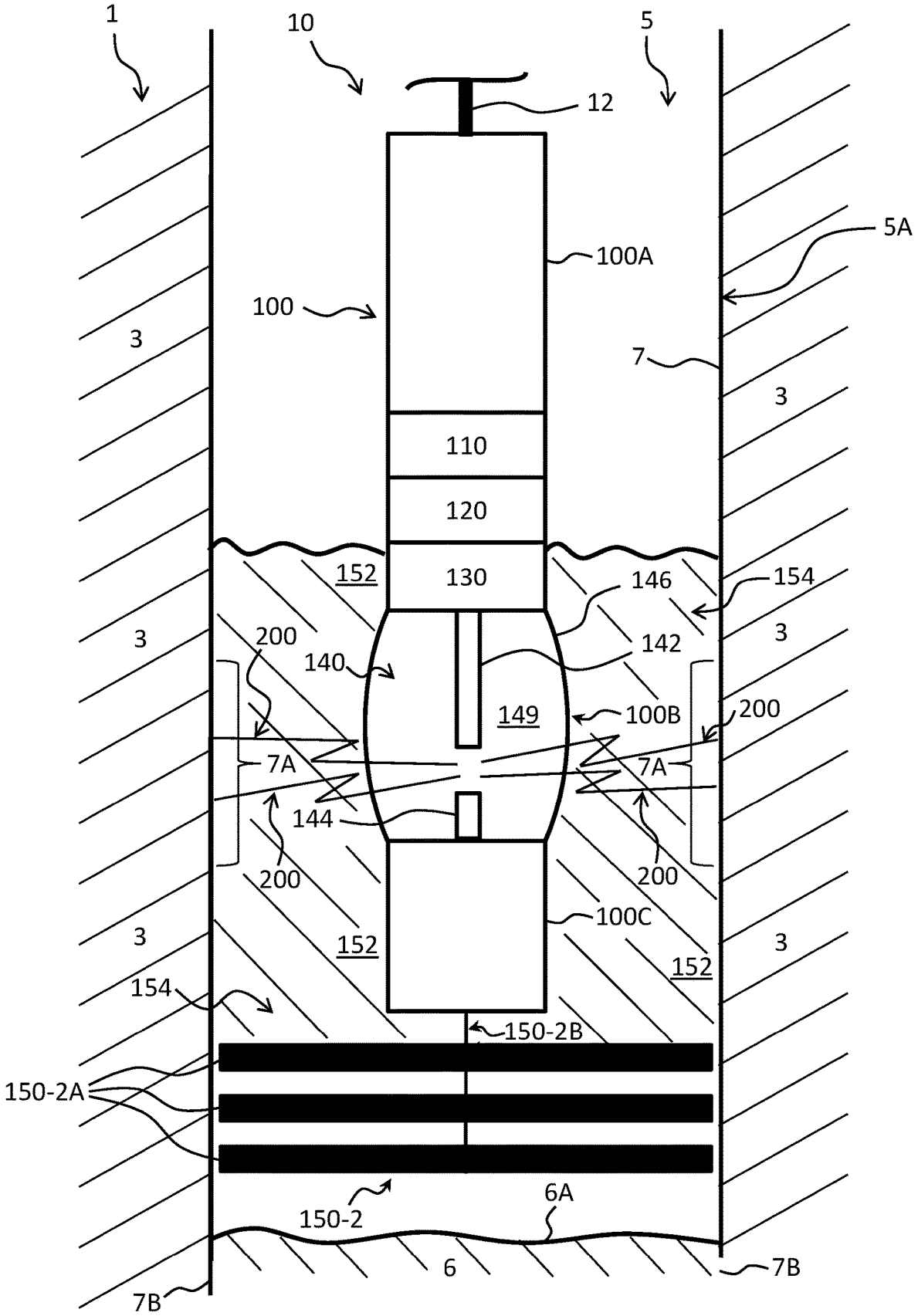
FIG. 3 schematically illustrates a cross-sectional view of a wellbore comprising a casing and a second embodiment of an electrical discharge generating device according to the invention.

In the embodiment of FIG. 3, the retaining module 150-2 comprises a plurality of superimposed retaining rings 150-2A (or disks) mounted on a shaft 150-2B (or a rod) extending vertically below the bottom part 100C.

Figure 4:
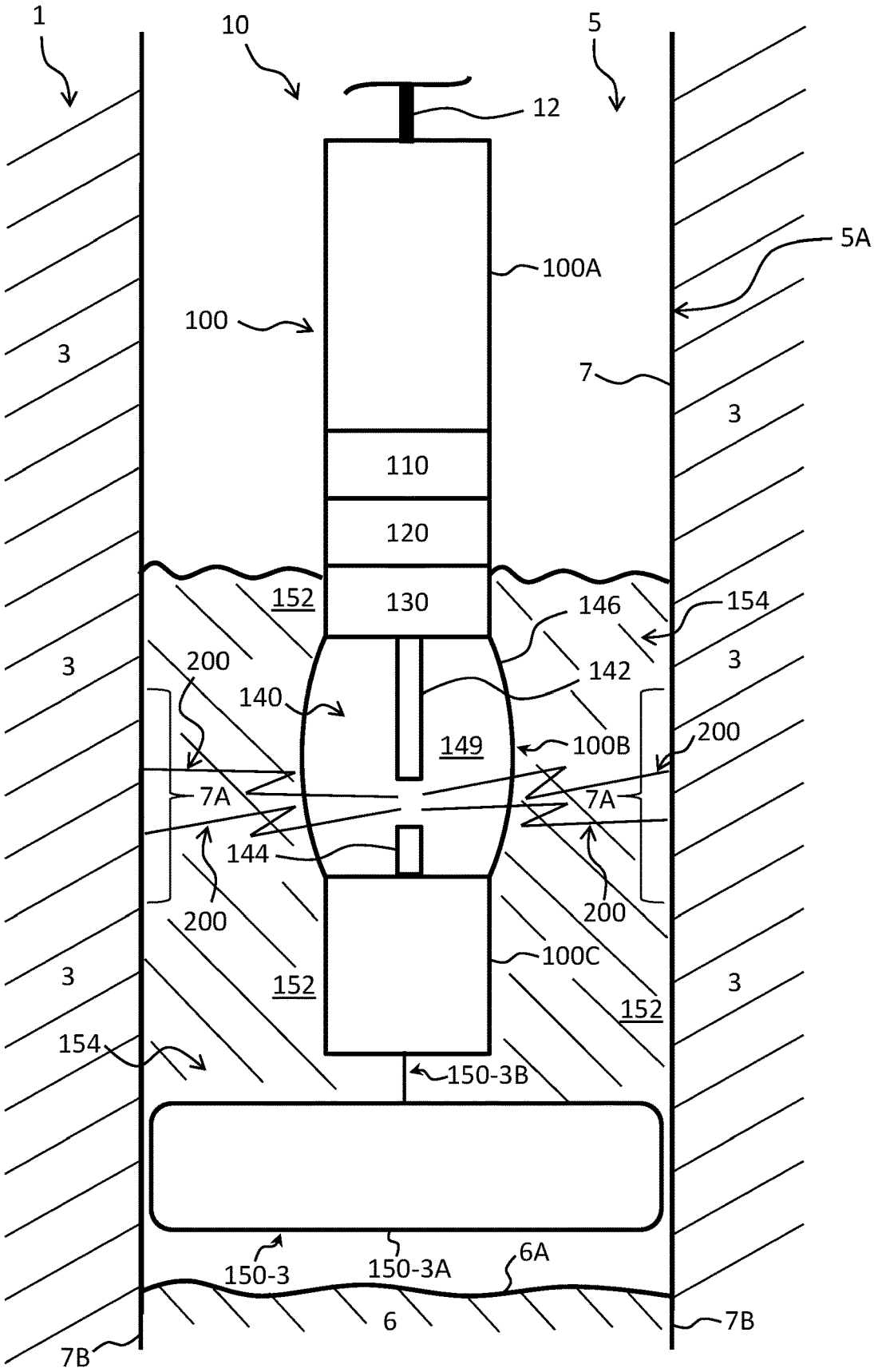
FIG. 4 schematically illustrates a cross-sectional view of a wellbore comprising a casing and a third embodiment of an electrical discharge generating device according to the invention.

In the embodiment of FIG. 4, the retaining module 150-3 comprises an inflatable element 150-3A attached to the bottom part 100C via a rod 150-3B.

In another embodiment, the retaining module could be the bottom part 100C of the body 100 of the device 10 which would be shaped adequately, for example like an inverted cone, a plurality of rings or an inflatable element.

Example of Operation

Figure 5:
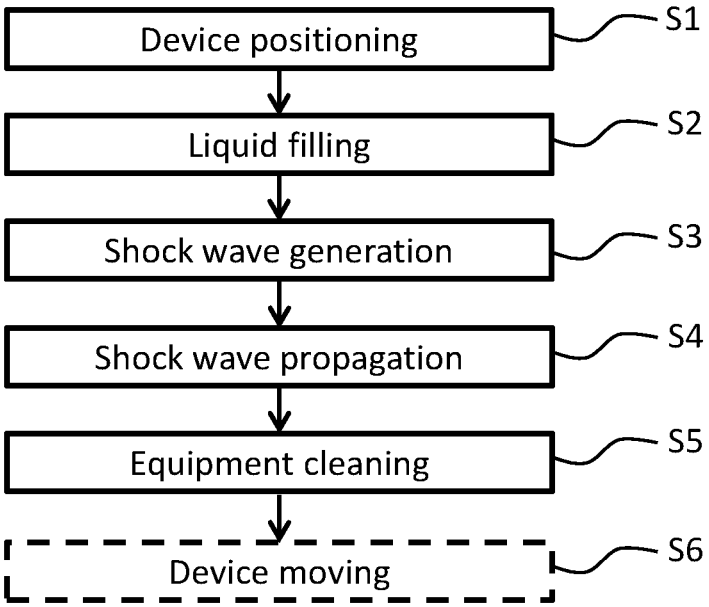
FIG. 5 schematically illustrates an embodiment of the method according to the invention.

In reference to FIG. 5, the electrical discharge generating device 10 is first positioned, in step S1, inside a dry part 7B of the casing 7 that needs cleaning. When the electrical discharge generating device 10 is positioned, the retaining module 150-1, 150-2, 150-3 seals at least partially the interface between said retaining module 150-1, 150-2, 150-3 and the target part 7A of the casing 7 (i.e. the part 7A to be cleaned).

Liquid is thus filled from the surface in the wellbore 5 in a step S2 until the discharge unit 140 and the target part 7A are immersed in said liquid, called "external transmitting liquid", for allowing an electrical discharge to be transmitting in said external transmitting liquid up to said immersed target part 7A. When the seal between the retaining module 150-1, 150-2, 150-3 and the target part 7A of the casing 7 is not perfect (i.e. not fully waterproof), it is necessary that the liquid flowing in from the surface is at least equal to volume of liquid that overflow between the retaining module 150-1, 150-2, 150-3 and the target part 7A of the casing 7 in order to maintain a sufficient volume of liquid above the retaining module 150-1, 150-2, 150-3 to immerse the discharge unit 140.

In step S3, at least one shock wave 200, preferably a series of several shock waves 200 (for example propagated at a periodic interval of time, e.g. every 5 to 20 seconds), is generated into the internal transmitting liquid by the discharge unit 140. This at least one shock wave 200 propagates in a step S4 through the membrane 146 and the external transmitting liquid toward the target part 7A of the casing 7.

In a step S5, the at least one propagated shock wave 200 reaches the immersed part 7A of the body 7 and clean said immersed part 7A (for example remove the deposits attached to said part 7A). A plurality of series may be advantageously repeated towards the part 7A at different heights to efficiently clean said part 7A and improve the recovery of oil or gas and the stimulation of the wellbore 5.

The electrical discharge generating device 10 may then be moved, in step S6, to another position inside the wellbore 5 in order to clean another part 7A of the casing 7 or another equipment of the wellbore such as e.g. a production tubing or a well production equipment.

Embodiments include many additional standard components or equipment that enables and makes operable the described device, process, method and system. Operation, control and performance of portions of or entire steps of a process or method can occur through human interaction, pre-programmed computer control and response systems, or combinations thereof.

The method according to the invention is not limited to a casing 7 and may be used to remove deposits on various different wellbore equipment installed above the wellbore liquid level 6A such as e.g. a sand control screen, a slotted liner, a perforated liner, a valve, a port, etc. The method according to the invention is not limited to a production wellbore and may be used into an abandoned wellbore or an injection wellbore such as a chemical or vapor injection wellbore. The invention is not limited to the described embodiment and can be applied to all type of formation fluids or gases transportation means.

| Table of references |
|---|
| subterranean formation 1 |
| treatment zone 3 |
| wellbore 5 |
| wellbore wall 5A |
| wellbore liquid 6 |
| wellbore liquid level 6A |
| casing 7 |
| parts 7A |
| parts 7B |
| electrical discharge generating device 10 |
| wireline 12 |
| body 100 |
| top part 100A |
| intermediate part 100B |
| bottom part 100C |
| power conversion unit 110 |
| power storage unit 120 |
| control unit 130 |
| discharge unit 140 |
| first electrode 142 |
| second electrode 144 |
| membrane 146 |
| chamber 148 |
| Internal transmitting liquid 149 |
| retaining module 150-1 |
| cone 150-1A |
| rod 150-1B |
| retaining module 150-2 |
| retaining disks 150-2A |
| a shaft 150-2B |
| retaining module 150-3 |
| inflatable element 150-3A |
| rod 150-3B |
| external transmitting liquid 152 |
| volume 154 |
| shock wave 200 |

The invention claimed is:

1. An electrical discharge generating device for cleaning an equipment arranged in a wellbore of a subterranean formation in order to improve the recovery of formation fluids and/or gases, said electrical discharge generating device comprising a discharge unit for generating at least one electrical discharge that propagates at least one shock wave for cleaning said equipment, wherein said electrical discharge generating device further comprises a retaining module;

wherein said retaining module comprises a retaining element fixed to the bottom part of the body of the device via a rod or a shaft and configured to retain a liquid in order to immerse the discharge unit when positioned in a wellbore;

wherein the retaining module comprises a retaining element configured to retain a liquid in order to immerse the discharge unit when positioned in a wellbore;

wherein the retaining element is fixed to the bottom part of the body of the device via a rod or a shaft.

2. A device according to claim 1, wherein the retaining element is made of a plastic material.

3. A device according to claim 1, wherein the retaining element is a cone, the vertex of which pointing downwards, extending under the bottom part of the body of the device and configured to retain a liquid in order to immerse the discharge unit when positioned in a wellbore.

4. A device according to claim 1, wherein the retaining element comprises a plurality of rings configured to retain a liquid in order to immerse the discharge unit when positioned in a wellbore.

5. A device according to claim 1, wherein the retaining element is an inflatable element extending from the bottom part of the body and configured to retain a liquid in order to immerse the discharge unit when positioned in a wellbore.

6. A device according to claim 1, wherein, said electrical discharge generating device comprising a body and said body comprising a bottom part, said bottom part being shaped so as to retain a liquid in order to immerse the discharge unit when positioned in a wellbore.

7. A device according to claim 6, wherein the bottom part is made of a plastic material.

8. A device according to claim 6, wherein the bottom part may be made of a metal material.

9. A device according to claim 6, wherein the bottom part comprises a cone shaped portion, the vertex of which pointing downwards, configured to retain a liquid in order to immerse the discharge unit when positioned in a wellbore.

10. A device according to claim 6, wherein the bottom part comprises a plurality of rings configured to retain a liquid in order to immerse the discharge unit when positioned in a wellbore.

11. A device according to claim 6, wherein the bottom part comprises an inflatable element configured to retain a liquid in order to immerse the discharge unit when positioned in a wellbore.

12. A method for cleaning an equipment arranged in a wellbore of a subterranean formation using an electrical discharge generating device in order to improve the recovery of formation fluids and/or gases, said electrical discharge generating device comprising a discharge unit for generating at least one electrical discharge that propagates at least one shock wave for cleaning said equipment, wherein, the device according to claim 1, is configured for retaining a volume of liquid in order to immerse the discharge unit, the method comprises the steps of positioning the device next to a wellbore equipment, filling a liquid in the wellbore so that retaining module retains a volume of liquid in order to immerse the discharge unit, and generating at least one electrical discharge into said retained liquid that propagates at least one shock wave for cleaning said equipment.

* * * * *